US009220158B2

(12) United States Patent
Van Herpen et al.

(10) Patent No.: US 9,220,158 B2
(45) Date of Patent: Dec. 22, 2015

(54) AMBIENCE CINEMA LIGHTING SYSTEM

(75) Inventors: Maarten Marinus Johannes Wilhelmus Van Herpen, Heesch (NL); Marcellinus Petrus Carolus Michael Krijn, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 772 days.

(21) Appl. No.: 13/516,811

(22) PCT Filed: Dec. 13, 2010

(86) PCT No.: PCT/IB2010/055766

§ 371 (c)(1),
(2), (4) Date: Jun. 18, 2012

(87) PCT Pub. No.: WO2011/073877

PCT Pub. Date: Jun. 23, 2011

(65) Prior Publication Data

US 2012/0262072 A1 Oct. 18, 2012

(30) Foreign Application Priority Data

Dec. 17, 2009 (EP) ..... 09179581

(51) Int. Cl.
*H05B 37/02* (2006.01)

(52) U.S. Cl.
CPC ..... *H05B 37/029* (2013.01)

(58) Field of Classification Search
CPC ..... H05B 37/029
See application file for complete search history.

(56) References Cited

U.S. PATENT DOCUMENTS

| | | | | |
|---|---|---|---|---|
| 5,026,152 | A | 6/1991 | Sharkey | |
| 6,611,297 | B1 * | 8/2003 | Akashi et al. | 348/739 |
| 7,430,018 | B1 | 9/2008 | Patel | |
| 7,499,214 | B2 | 3/2009 | Novet et al. | |
| 7,932,953 | B2 * | 4/2011 | Gutta et al. | 348/602 |
| 7,942,540 | B2 * | 5/2011 | Harbers et al. | 362/84 |
| 8,599,313 | B2 * | 12/2013 | Barenbrug et al. | 348/563 |
| 2007/0126864 | A1 * | 6/2007 | Bhat et al. | 348/51 |
| 2009/0109340 | A1 * | 4/2009 | Iwanami et al. | 348/602 |
| 2009/0256962 | A1 * | 10/2009 | Iwanami et al. | 348/552 |
| 2009/0322955 | A1 * | 12/2009 | Iwanami et al. | 348/687 |
| 2011/0115979 | A1 * | 5/2011 | Aoki et al. | 348/602 |
| 2011/0190911 | A1 * | 8/2011 | Iwanami et al. | 700/90 |
| 2011/0316426 | A1 * | 12/2011 | Iwanami et al. | 315/151 |
| 2014/0002479 | A1 * | 1/2014 | Muijs et al. | 345/589 |

FOREIGN PATENT DOCUMENTS

| | | | |
|---|---|---|---|
| JP | 2001343900 | A2 | 12/2001 |
| JP | 2009064594 | A | 3/2009 |

(Continued)

*Primary Examiner* — Thomas J Hiltunen

(57) ABSTRACT

The present invention relates to a method for providing an ambience light effect in a cinema comprising a cinema display screen arranged on a front wall of the cinema and a plurality of light sources, comprising receiving first and second image content to be sequentially displayed on the cinema display screen, determining at least one of a color and intensity for the second image content, determining a second set of control data for controlling the plurality of light sources to emit an ambient light effect based on at least one of the color and intensity for the second image content, and associating the second set of control data with the first set of image content. Advantages with the invention include the possibility to provide an improved ambient lighting experience by using the "extra space" specifically available in a cinema, e.g. walls, floor and ceiling.

12 Claims, 3 Drawing Sheets

(56) References Cited

FOREIGN PATENT DOCUMENTS

| | | | |
|---|---|---|---|
| WO | 2006003602 | A1 | 1/2006 |
| WO | 2008068698 | A1 | 6/2008 |
| WO | 2008078233 | A1 | 7/2008 |

* cited by examiner

122

120
114
100
104
112
110
108
106
116
102
124

128
126
118

AMBIENCE CINEMA LIGHTING SYSTEM

TECHNICAL FIELD

The present invention relates to an ambience lighting system. The present invention also relates to a method for controlling an ambience lighting system.

BACKGROUND OF THE INVENTION

In recent years, so-called ambilight TV sets have been very popular amongst TV buyers. Such ambilight systems generate light based on incoming video signals such that a background light is emitted on the wall behind the TV that matches the video being shown. The effect is a larger virtual screen and a more immersive viewing experience.

An example of an extension of such an ambilight TV set is disclosed in WO08068698, providing a system for facilitating accompanying an image or video rendering with a concurrent controlled ambient lighting. The system may be provided as a home entertainment system, e.g. provided in a living room. The home entertainment system comprises a display and light sources, in the form of "light speakers", for example arranged in each corner of the living room. By means of the system of WO08068698 it may be possible to further extend the experience of ambient lighting to also cover further areas of the living room.

However, even though the system of WO08068698 provides interesting features for further enhancing the ambient lighting experience when viewing video or images on a TV screen, it may be desirable to provide further improvements, for example suitable for larger display screens such as are provided within a cinema setting.

SUMMARY OF THE INVENTION

According to an aspect of the invention, the above is at least partly met by a method for providing an ambience light effect in a cinema comprising a cinema display screen arranged on a front wall of the cinema and a plurality of light sources, comprising receiving first and second image content to be sequentially displayed on the cinema display screen, determining at least one of a color and intensity for the second image content, determining a second set of control data for controlling the plurality of light sources to emit an ambient light effect based on at least one of the color and intensity for the second image content, and associating the second set of control data with the first set of image content. Advantages with the invention include the possibility to provide an improved ambient lighting experience by using the "extra space" specifically available in a cinema, e.g. walls, floor and ceiling. That is, the image content to be displayed on the cinema display screen also extends onto the extra space, taking into account knowledge about image content that already has been shown on the cinema display screen or that will be shown. For simplicity in analyzing the image content, the image content is preferably digitalized. However, it may of course be possible to perform analysis of image content also in cases where the image content is analogue.

An example of a possibly scenario used in conjunction with the inventive method, comprising three states, is a colored car approaching from the left hand side of the cinema display screen and moving towards the right hand side of the cinema display screen. In the first state the car is not shown on the cinema display screen, but a selective set of the plurality of light sources arranged on the left hand side of the cinema display screen will emit light of a color matching the color of the car. In the second state the car is shown on the cinema display screen without any or only with a support of a small set of the portion of plurality of light sources arranged surrounding the cinema display screen, followed by the third state where the car once again is not shown on the cinema display screen, but where a selective set of the plurality of light sources arranged on the right hand side of the cinema display screen will emit light of a color matching the color of the car. Effectively, the movement of the car from the left hand side of the cinema display screen to the right hand side of the cinema display screen has been extended in time, thus enhancing the visual experience for spectators of the image content being displayed on the cinema display screen, e.g. comprising moving (i.e. video) and/or still image content. The intensity and color of the light emitted by the plurality of light sources may depend on the color and intensity of e.g. the most dominant object within the image content, but may also in a more simple way only depend on the overall average intensity and color of the image content.

Furthermore, as the plurality of light sources may be spaced apart from each other within the cinema, it is possible to see each of the plurality of light sources as independent "ambient lighting pixels" that are individually controllable. Accordingly, in a scenario as exemplified above, it may also be possible to allow for spatial control, e.g. by allowing the light sources most far away from the cinema display screen, on its left hand side, to start emit light with a color matching the car before light sources more close to the cinema displays screen starts to emit light matching the car.

As understood from the above example, the control data depending on at least one of the color and intensity for the image content not currently shown on the cinema display screen is used for controlling the plurality of light source, i.e. the first image content is shown simultaneously with controlling the plurality of light sources using the second set of control data depending in the second image content. It is of course possible to display the first image content on the cinema display device before the second image content, as well as displaying the second image content is displayed on the cinema display device before the first image content. Accordingly, an extension of the visual experience is possible time-wise in both directions, i.e. image content to be displayed is preceded by light emitted by the plurality of light sources as well as being followed by light emitted by the plurality of light sources, effectively allowing for a time-varying gradient in both color and intensity across the surrounding surfaces, based on the image content.

It should be understood that the analysis of the image content and the determination of the control data may be accomplished both "online" and "offline", i.e. the analysis and determination may be done at the same time as the image content is shown on the cinema display screen, but may also be done in advance. In such a case, the control data may be distributed separately with the image content, for example as a control data file having time-wise connection with the image content.

According to another aspect of the invention, there is provided an ambience lighting system for a cinema display screen arranged on a front wall of a cinema, comprising a control unit, a plurality of light sources being connected to the control unit and configured to emit an ambience light effect, wherein the plurality of light sources are arranged spaced apart on side walls of the cinema, possibly comprising wall-washers. Alternatively, the plurality of light sources may be provided as a light emitting textile covering at least one of seats, a wall, a floor, and a ceiling of the cinema. Still further, the plurality of light sources may alternatively be provided as a light emitting plaster covering at least one of a wall, a floor, and a ceiling of the cinema. It is also possible and within the scope of the invention to combine the above placement methods for the plurality of light sources, including individual control of each of the light sources.

The different placement methods for the plurality of light sources provided above may be suitable for different conditions and implementations (e.g. new construction or refurbish of cinema). In refurbishing a cinema, wall washers may be provided on side walls of the cinema, essentially perpendicular to the cinema display screen. A particular advantage of this embodiment is that a strong ambient lighting effect may be created for spectators sitting in a row in the back of the cinema, because the walls surrounding these rows can now also participate in the ambient lighting effect.

In regards to textile covering having "hidden light sources", this may be advantageous from an acoustic perspective. The cover layer of this textile may be a woven fabric, but in a preferred embodiment the cover layer is a light emitting carpet or the light sources are embedded in the fabric of the chairs within the cinema. Preferably, a light-transmissive carpet may be used, with a lighting system placed underneath the carpet. Additionally and as stated above, it may be possible to provide embedded light sources in e.g. a building material used for building e.g. a ceiling, floor or the walls of the cinema.

Preferably, the control unit is configured to receive first and second image content to be sequentially displayed on the cinema display screen, determine at least one of a color and intensity for the second image content, determine a second set of control data for controlling the plurality of light sources to emit an ambient light effect based on at least one of the color and intensity for the second image content, and controlling the plurality of light sources to emit the ambience light effect using the second set of control data simultaneously with the first image content being displayed on the cinema display screen. This embodiment of the invention provides similar advantages as discussed above in relation to the previous aspect of the invention.

As understood, the ambience lighting system may also form part of a cinema, further comprising a cinema display screen and possibly means for displaying image content onto the cinema display screen, e.g. a cinema projector.

Further features of, and advantages with, the present invention will become apparent when studying the appended claims and the following description. The skilled person realize that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawings, in which.

DETAILED DESCRIPTION

Figures 1, 2, 3, 4:
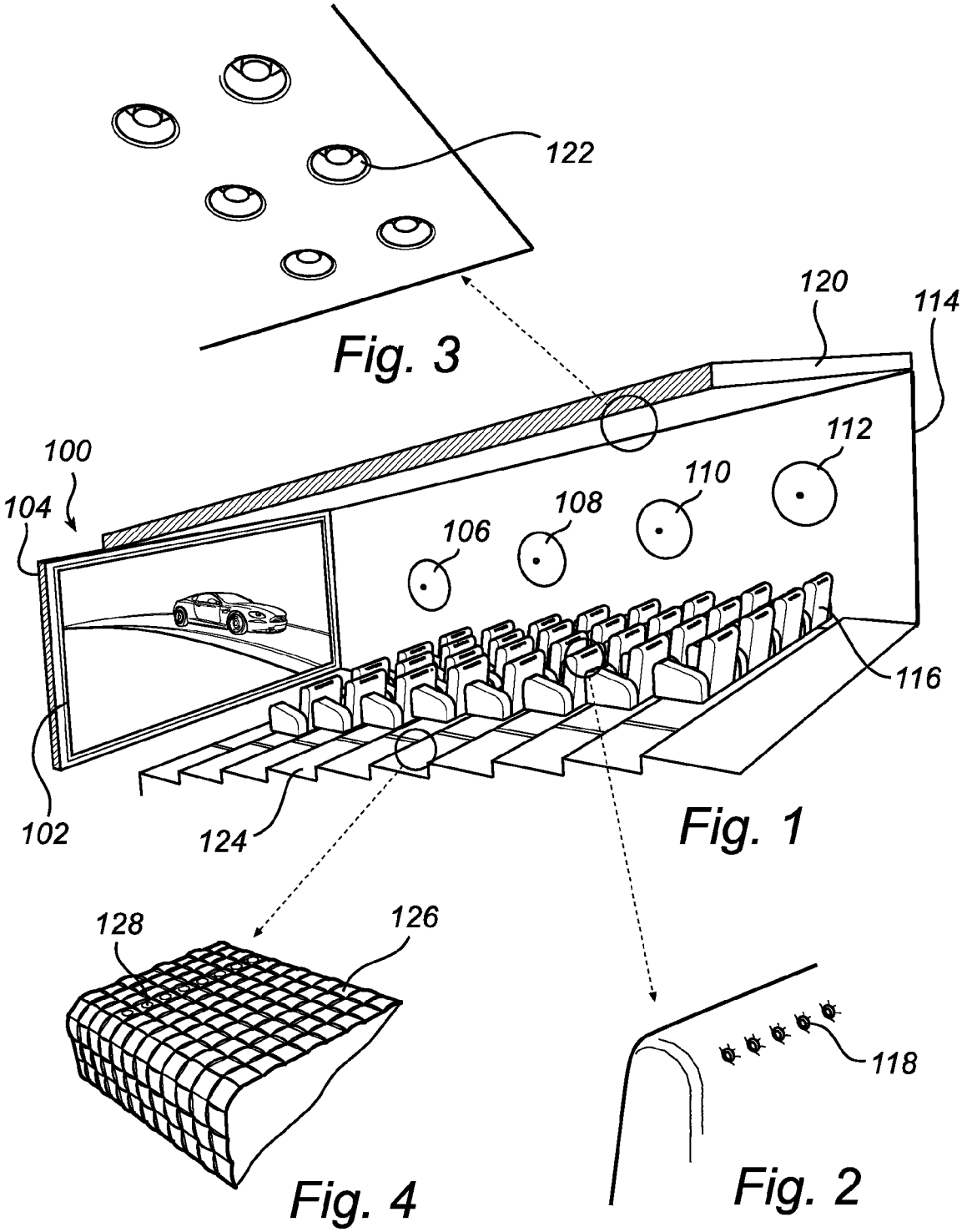
FIG. 1-4 illustrates a cinema comprising an ambience lighting system according to a currently preferred embodiment of the invention.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Referring now to the drawings and to FIG. 1-4 in particular, there is depicted a cinema 100 comprising cinema display screen 102 arranged on the front wall 104 of the cinema 100, a plurality of light sources such as wall washers 106, 108, 110, 112 arranged spaced apart on a right hand side wall 114 of the cinema 100. A left hand side wall of the cinema may of course be provided with similar types of correspondingly arranged light sources. Within the cinema 100, there are provided a plurality of chairs 116, each having embedded light sources 118 in the textile of the chairs 116, possibly at the back of each chair (other placements are of course possible, such as within the arm rests of the chairs). Also, a roof 120 of the cinema is provided with a material, e.g. plaster, configured to have embedded light sources 122. Additionally, the floor 124 of the cinema 100 is provided with a textile floor covering 126 having embedded light sources 128. For embedding the light sources within the textile chairs/floor of the cinema and/or the roof of the cinema, different methods are known to the skilled person and possible within the scope of the invention. Furthermore, it is not necessary to include all of the above types of light sources within the cinema 100. Rather, a selected sub-set of the above described light sources may be used for providing the ambient lighting in the cinema as provided according to the invention.

To achieve a high energy efficiency the light source 106, 108, 110, 112, 118, 122 and 128 may preferably be selected from a group comprising light emitting diodes (LEDs), organic light emitting diodes (OLEDs), polymeric light emitting diodes (PLEDs), inorganic LEDs, cold cathode fluorescent lamps (CCFLs), hot cathode fluorescent lamps (HCFLs), plasma lamps. LEDs have much higher energy efficiency in comparison to conventional light bulbs which generally deliver at best about 6% of their electric power used in the form of light. The skilled person would appreciate that it of course would be possible to use a standard incandescent light source, such as an argon, krypton, and/or xenon light source. In an even more preferred embodiment, the light sources may for example comprise a combination of at least some of red, green, blue, yellow, magenta and cyan LEDs for creating mixed color lighting. It is however also possible to use one or a plurality of white LEDs. Further combinations are also possible.

For controlling the light sources, there may be provided a control unit (not shown) configured in electrical connection with, optionally, each of the light sources for allowing individual control of each of the light sources. A connection to the means for displaying images/video sequences onto the cinema display screen 102 is also provided for controlling when to drive the light sources to emit ambient lighting. The control unit may include a microprocessor, microcontroller, programmable digital signal processor or another programmable device. The control unit may also, or instead, include an application specific integrated circuit, a programmable gate array or programmable array logic, a programmable logic device, or a digital signal processor. Where the control unit includes a programmable device such as the microprocessor, microcontroller or programmable digital signal processor mentioned above, the processor may further include computer executable code that controls operation of the programmable device.

Figure 5:
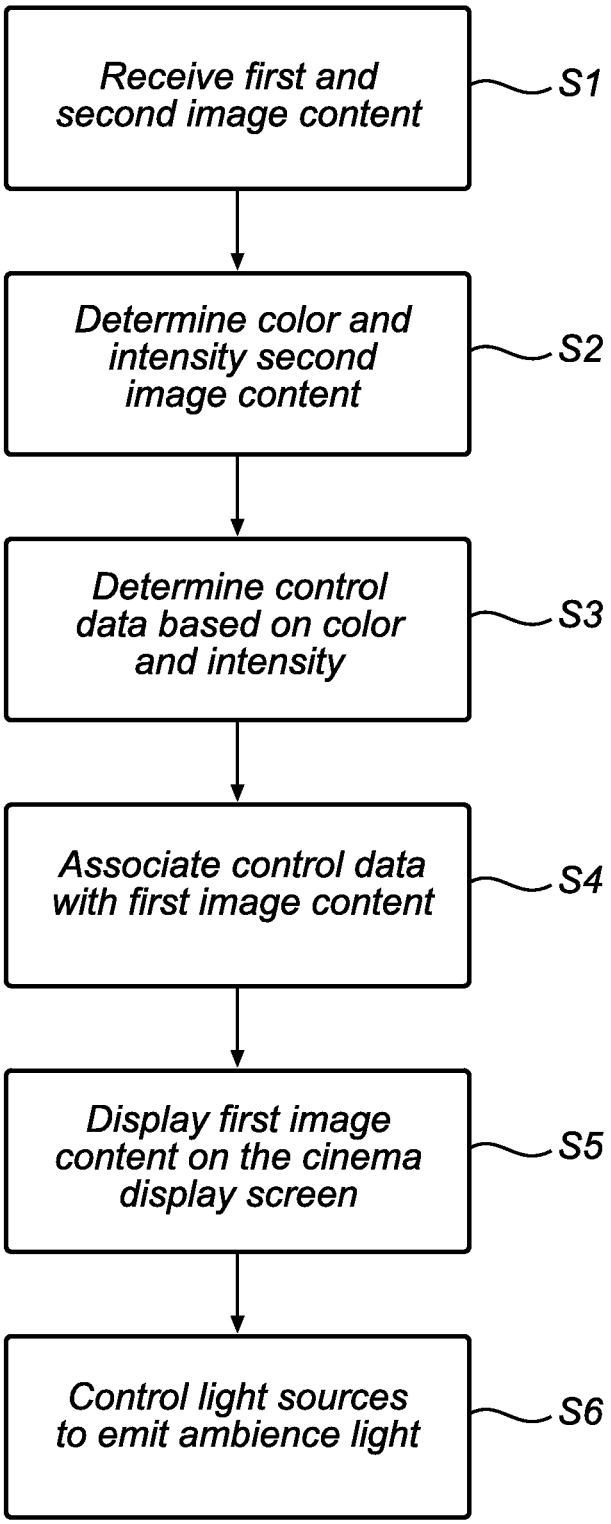
FIG. 5 illustrates a conceptual flow chart of a method for controlling the ambience lighting system.

With reference to FIG. 5, the control unit may also be configured to during displaying of the images/video sequences onto the cinema display screen 102 analyze the images/video sequences to provide the control data for driving the light sources. Accordingly, the control unit may in a first step, S1, receive first and second image content, such as for example images and/or portions of video sequences that are intended to be consequently displayed on the cinema display screen 102. For example, in a possible scenario, the first and second image content comprises the imaging content necessary for displaying a road and a red car moving from the left hand side of the cinema display screen to the right hand side of the cinema display screen, the first image content to be displayed before the second image content. Accordingly, the first image content may comprise the visualization of an empty road, and the second image content may comprise the red car appearing on the left hand side of the cinema display screen.

Thus, in a second step, S2, the control unit may be configured determine a, possibly dominant, color of the second image content, in the exemplary scenario the red color of the car. The intensity of the second image content may also be determined and used in correlation with the color.

Following the determination of the color and intensity, the control unit may in a third step, S3, determine control data for controlling the light sources to emit ambient lighting. The determination of the control data is preferably done having at least some knowledge of the placement of the light sources, e.g. in relation to their placement on the left and right hand side of the cinema display screen and/or in relation to their individual spatial placement on e.g. a side wall. Accordingly, the control data preferably takes into account the placement of the individual light sources intended to be used for the ambient lighting in combination with the color and intensity of the image content to be displayed on the cinema display screen "in the future".

The control data resulting from the second image content is in a fourth step, S4, associated with the first image content, thereby allowing for the possibility to extend the visual experience of actual image content displayed on the cinema display screen. In relation to the possible scenario with the red car, the first image content is associated with control data being based on the red car of the second image content that may be used to control light sources on the left hand side of the cinema display screen to emit ambient light having a red color. Thereafter in a fifth and sixth step, S5-S6, the first image content is displayed on the cinema display screen at the same time as the light sources are controlled using the control data corresponding to the second image content for driving the light sources to emit ambient light.

As discussed above, the first image content is displayed before the second image content. This may of course work the other way around, i.e. the second image content being displayed before the first image content, effectively allowing for the extension of the visual experience from a time-wise perspective in both directions, i.e. before the first image content is displayed as well as after the first image content is displayed. In relation to the scenario with the red car, this would allow for ambient light to be provided on the left hand side of the cinema display screen before the car appears on the left hand side, as well as on the right hand side of the cinema display screen after the car disappears on the right hand side of the cinema display screen.

Figure 6A:
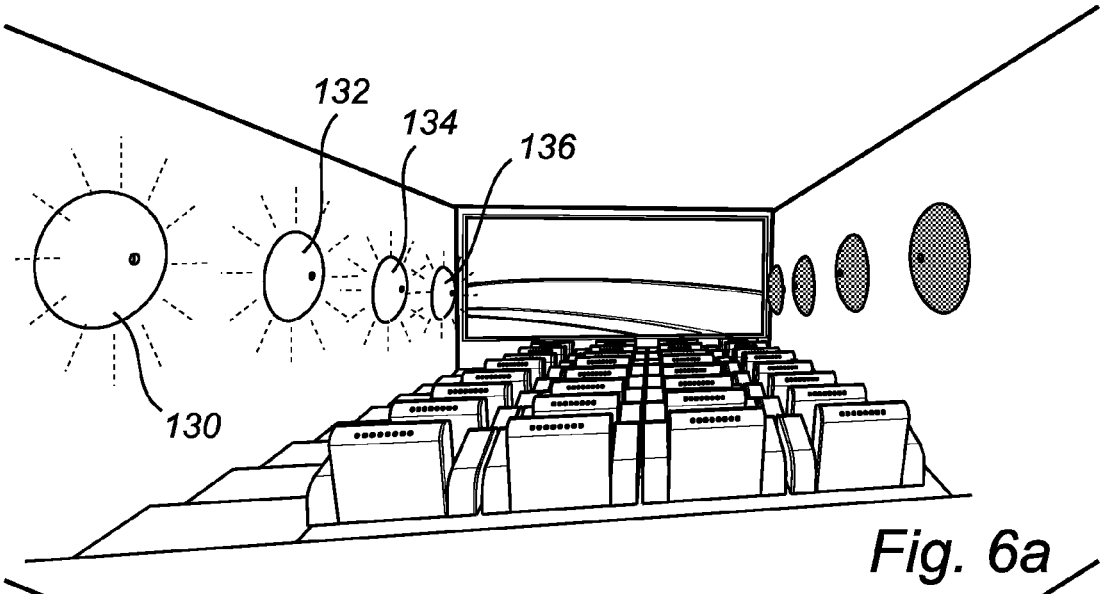
FIGS. 6*a*-6*c* illustrate an exemplary operation of the ambience lighting system in a cinema.
Figure 6B:
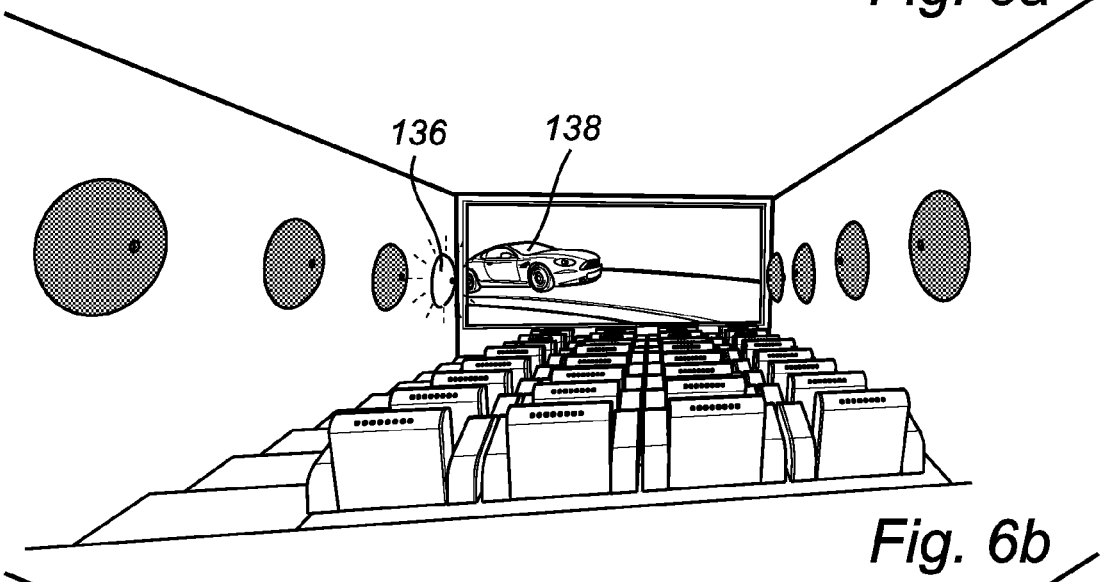
Figure 6C:
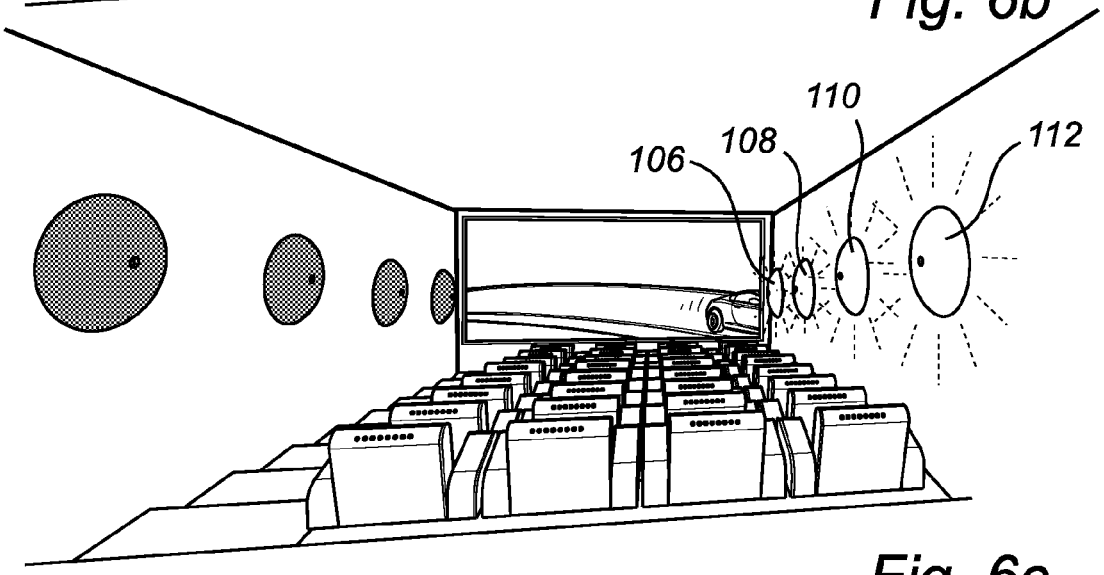

The scenario with a car 138 approaching on an empty road from the left hand side of the cinema display screen 102 towards the right hand side of the cinema display screen 102 is exemplified in FIG. 6*a*-6*c*, in essence corresponding to the cinema illustrated in FIG. 1. In FIG. 6*a*, the second image content has been analyzed and control data corresponding to the second image content is used for driving light sources 130, 132, 134, 136 arranged on the left hand side of the cinema display screen 102. As the video sequence to follow will see the car 138 moving from the left to the right of the cinema display screen 102, it is possible also to take into account the spatial distribution of the light sources 130, 132, 134, 136 such that light source 130 starts to light before light source 132, light source 132 before light source 134 and so on. The visual expression for the spectators within the cinema 100 will extend the visual experience of the approaching car, giving an expression of future content to be displayed on the cinema display screen 102.

In FIG. 6*b*, the car 138 starts to show up on the left hand side of the cinema display screen 102. The possibility to individually control the light sources 130, 132, 134, 136 is used, and thus only the light source 136 for a spatial perspective closest to the cinema display screen 102 will be driven using control data to emit ambient light. Consequently, as the car 138 is about to leave the right hand side of the cinema display screen 102, with reference to FIG. 6*c*, the light sources 102, 108, 110, 112 on the right hand side of the cinema display screen will start to emit ambient light for extending, from a "delayed perspective" the virtual presence of the car 138 within the cinema 100.

Even though the invention has been described with reference to specific exemplifying embodiments thereof, many different alterations, modifications and the like will become apparent for those skilled in the art. Variations to the disclosed embodiments can be understood and effected by the skilled addressee in practicing the claimed invention, from a study of the drawings, the disclosure, and the appended claims. For example, the determination of the control data is as above discussed done "in real-time" at the same time as the image content is displayed on the cinema display screen. However, it is also possible and within the scope of the invention to allow for "offline" determination of the control data, for example at the same time as the images/video is prepared for cinema screening.

Furthermore, in the claims, the word "comprising" does not exclude other elements or steps, and the indefinite article "a" or "an" does not exclude a plurality.

The invention claimed is:

1. A method for providing an ambience light effect in a cinema comprising a cinema display screen arranged on a front wall of the cinema and a plurality of light sources, comprising:

receiving first and second image content to be sequentially displayed on the cinema display screen, wherein the first image content is to be displayed prior to the second image content;

determining at least one of a color and intensity for the second image content;

determining a set of control data based on the at least one of the color and intensity for the second image content; and controlling the plurality of light sources to emit the ambience light effect using the set of control data simultaneously with the first image content being displayed on the cinema display screen.

2. Method according to claim 1, wherein the first image content is displayed on the cinema display device before the second image content.

3. Method according to claim 1, wherein the second image content is displayed on the cinema display device before the first image content.

4. A method according to claim 1 wherein the determination of the control data is further based on information about the placement of the light sources relative to the cinema display screen and/or relative to their individual spatial placement on a side wall.

5. A method according to claim 4 wherein the determination of the control data is further based on information about the placement of the light sources relative to their individual spatial placement on a side wall.

6. A control unit for an ambience lighting system for a cinema display screen arranged on a front wall of a cinema comprising a plurality of light sources, each being external to the display screen, the control unit being configured to:

receive first and second image content to be sequentially displayed on the cinema display screen, wherein the first image content is to be displayed prior to the second image content;

determine at least one of a color and intensity for the second image content;

determine a set of control data based on the at least one of the color and intensity for the second image content; and control the plurality of light sources to emit the ambience light effect using the set of control data simultaneously with the first image content being displayed on the cinema display screen.

7. A control unit according to claim 6, being configured to determine the control data based on the color and intensity of the most dominant object within the second image content and/or the overall average intensity and color of the second image content.

8. A control unit according to claim 6, wherein the control unit is further configured to control the light sources individually.

9. An ambience lighting system for a cinema display screen arranged on a front wall of a cinema, the lighting system comprising:

a control unit as defined in claim 6; and, a plurality of light sources, each being connected to the control unit and configured to emit an ambience light effect.

10. An ambience lighting system as defined in claim 9, wherein the plurality of light sources are selected from the group consisting of:

a light source arranged space apart on side walls of the cinema;

a light source provided as a light emitting textile covering at least one of seats, a wall, a floor, and a ceiling of the cinema; and a light source provided as a light emitting plaster covering at least one of a wall, a floor, and a ceiling of the cinema.

11. Ambient lighting system according to claim 9, wherein the plurality of light sources comprises wall-washers.

12. A cinema, comprising a cinema display screen and an ambience lighting system according to claim 9.

* * * * *